United States Patent [19]

Schmidt

[11] Patent Number: 4,833,974

[45] Date of Patent: May 30, 1989

[54] RAM BORING MACHINE

[76] Inventor: Paul Schmidt, Reiherstr. 1, 5940 Lennestadt 1 (Saalhausen), Fed. Rep. of Germany

[21] Appl. No.: 47,880

[22] Filed: May 6, 1987

[30] Foreign Application Priority Data

Dec. 13, 1986 [DE] Fed. Rep. of Germany ..... 3642696

[51] Int. Cl.[4] ..... F15B 11/08

[52] U.S. Cl. ..... 91/468; 137/469

[58] Field of Search ..... 91/25, 432, 468, 419; 137/469, 471

[56] References Cited

U.S. PATENT DOCUMENTS

| | | | |
|---|---|---|---|
| 2,287,840 | 6/1942 | Stratton | 137/469 |
| 3,025,869 | 3/1962 | Kenfield | 137/469 X |
| 3,048,188 | 8/1962 | Hunter | 137/469 |
| 3,996,957 | 12/1976 | Goldish et al. | 137/469 X |
| 4,026,192 | 5/1977 | Noren | 91/25 |
| 4,266,465 | 5/1981 | Gaun | 91/25 |
| 4,563,938 | 1/1986 | Henriksson | 91/25 |
| 4,569,271 | 2/1986 | Reynolds | 91/25 |

*Primary Examiner*—Edward K. Look

*Attorney, Agent, or Firm*—Toren, McGeady & Associates

[57] ABSTRACT

In a pneumatic ram boring machine for laying pipelines without trenching, which is connected to a source of compressed air by a hose, a valve that suddenly opens automatically at a predetermined pressure is arranged upstream of the striker piston. On opening the valve a pressure wave results which reaches the impact piston almost undamped and prevents it from stopping at a dead center position and not starting.

10 Claims, 3 Drawing Sheets

RAM BORING MACHINE

TECHNICAL FIELD OF THE INVENTION

The invention relates to a ram boring machine connected by a hose to a source of compressed air and having a striker piston that is axially moveable in a tubular housing and is acted on on alternate sides by compressed air.

BACKGROUND OF THE INVENTION

Such ram boring machines are mainly used to lay water supply pipes or electricity or telephone cables without having to tear up the road surface or the sidewalk and dig a trench. They usually have an impact tip that is struck by a pneumatically operated striker piston. To drive the impact tip forwards the striker piston is moved to and fro in a tubular housing by compressed air, supplied through a compressed air line, acting alternately on the front and rear faces of the striker piston.

Most ram boring machines driven by compressed air are turned on and off by means of ordinary stopcocks, e.g. ball-valves.

Since relatively long hoses, from about 20 m to 100 m long, extend from the stop-cock at the source of compressed air to the ram boring machine, the pressure in the hose and in the ram boring machine builds up relatively slowly. As a result the striker piston can be moved unfavourably so that the front and back faces of the striker piston are subjected to the same pressure, resulting in a dead centre position from which the striker piston can only be caused to start up by a jolt with compressed air. This can be brought about for example by kinking the compressed air hose nd abruptly bending it back. However, this measure is ineffective if the ram boring machine has already penetrated so far into the ground that the length of the hose in the bore hole is more than 15 m to 20 m. Great problems are thus caused in the case of fairly long bore holes by starting difficulties.

OBJECT OF THE INVENTION

The object of the invention is to provide a starting means for ram boring machines that works even with relatively long compressed air hoses so that they can be started without difficulty.

SUMMARY OF THE INVENTION

According to the invention the object is achieved by a valve, arranged upstream from the striker piston, that opens suddenly and automatically at a predetermined pressure. This valve should be as near as possible to the striker piston and may therefore either be in the housing of the machine itself or in the hose between the machine and the source of compressed air, close to the machine.

Such a valve can be controlled either by compressed air, by hydraulic pressure or by gas pressure. A requirement for it to be effective is that a high enough pressure builds up in front of the valve, so that when the valve suddenly opens a pressure shock acts on the striker piston in the machine and immediately sets the working piston in motion.

The valve preferably has a moveable control piston, sealed in a housing, with the piston surfaces that are acted on hydraulically, by gas or by compressed air being of different sizes in the closed and open positions.

To ensure that the valve opens suddenly at a predetermined pressure the control piston is held by a spring acting in the direction of the closed position.

According to a preferred embodiment a tubular stepped piston that is sealed and guided in the housing is closed at one end, is sealed and guided in the housing in this region, and has radial through openings. At the other end it is provided with a piston section of larger diameter which is likewise sealed and guided in the housing.

As long as the stepped piston is in the closed position the compressed air only acts on the smaller diameter tubular piston, which is only moved when the pressure exceeds the strength of the spring holding the control piston in its closed position.

At the moment when the force of the compressed air acting on the control piston exceeds the oppositely acting force of the spring, the piston is displaced and the compressed air acts on the larger diameter section of the piston, so that the control piston is suddenly displaced and the valve is thus suddenly opened.

BRIEF DESCRIPTION OF THE DRAWINGS

The invention will now be described in more detail with reference to an exemplary embodiment shown in the drawings, in which.

DETAILED DESCRIPTION OF A PREFERRED EMBODIMENT OF THE INVENTION

Figure 1:
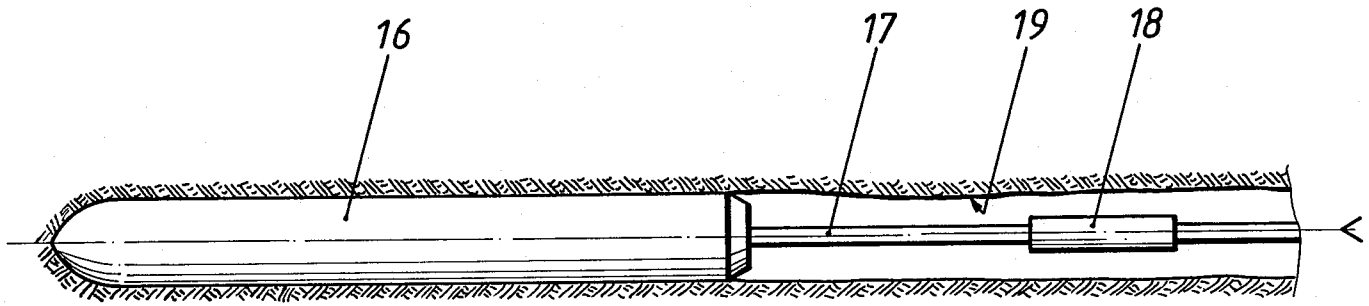
FIG. 1 shows a ram boring machine having a starting valve arranged in its compressed air hose.

A ram boring machine 16 is connected by a compressed air hose 17 to a source of compressed air (not shown). A starting valve 18 is arranged in the compressed air hose 17 near the ram boring machine 16. This starting valve 18 should be as close as possible to the ram boring machine 16, so that the pressure wave after the starting valve 18 is opened arrives at the strike piston in the ram boring machine so far as possible undamped. The starting valve 18 can therefore also be placed either directly on the ram boring machine 16 or even within the ram boring machine 16 itself.

The starting valve 18 consists of a cylindrical housing 2 closed at one end by means of a valve closure stopper. In the housing 2 there is a tubular piston 3 surrounded by a compression spring 5 arranged in an annular space 4 of the housing 2. On the valve closure stopper 1 there is a connection 6 for a compressed air hose. In addition the end of the valve closure stopper 1 forms an abutment surface 7. Spaced from this abutment surface 7 the housing 2 has a rebate 8 that likewise serves as a stop.

The tubular piston 3 is sealed and guided at one end in a bore 9 so that no compressed air can escape from radial through openings 10 in the tubular piston 3 in this region. For this reason the tubular piston 3 also has a closed end face 15.

Figure 2:
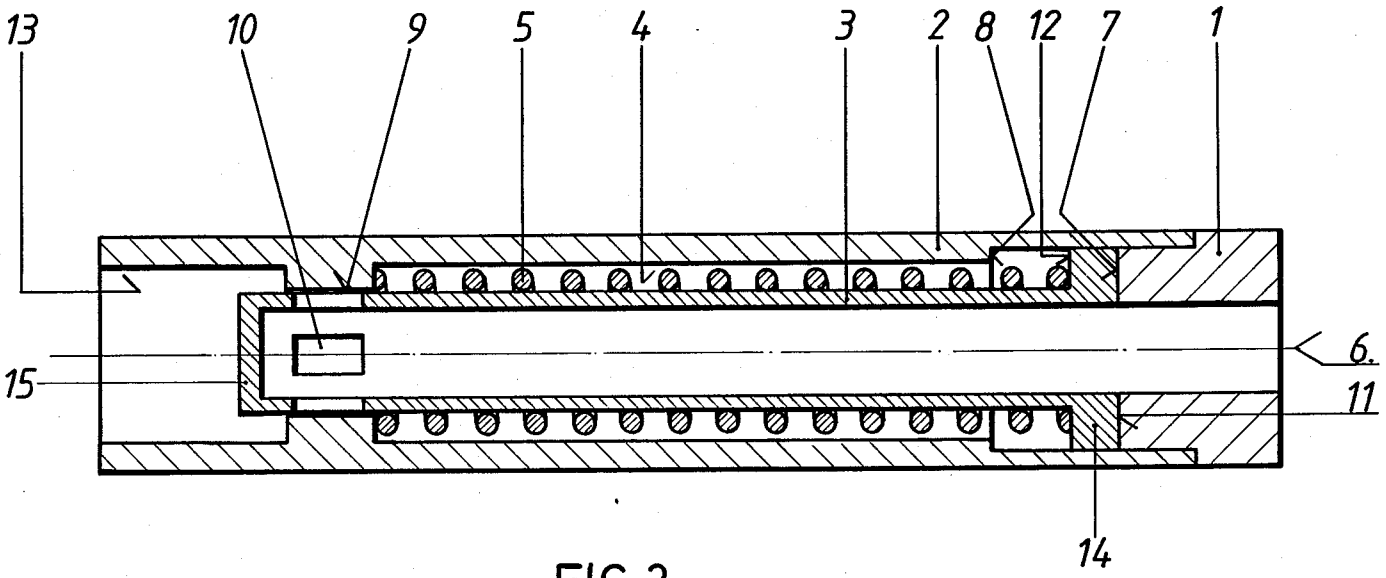
FIG. 2 is a section through the starting valve in the closed position.
Figure 3:
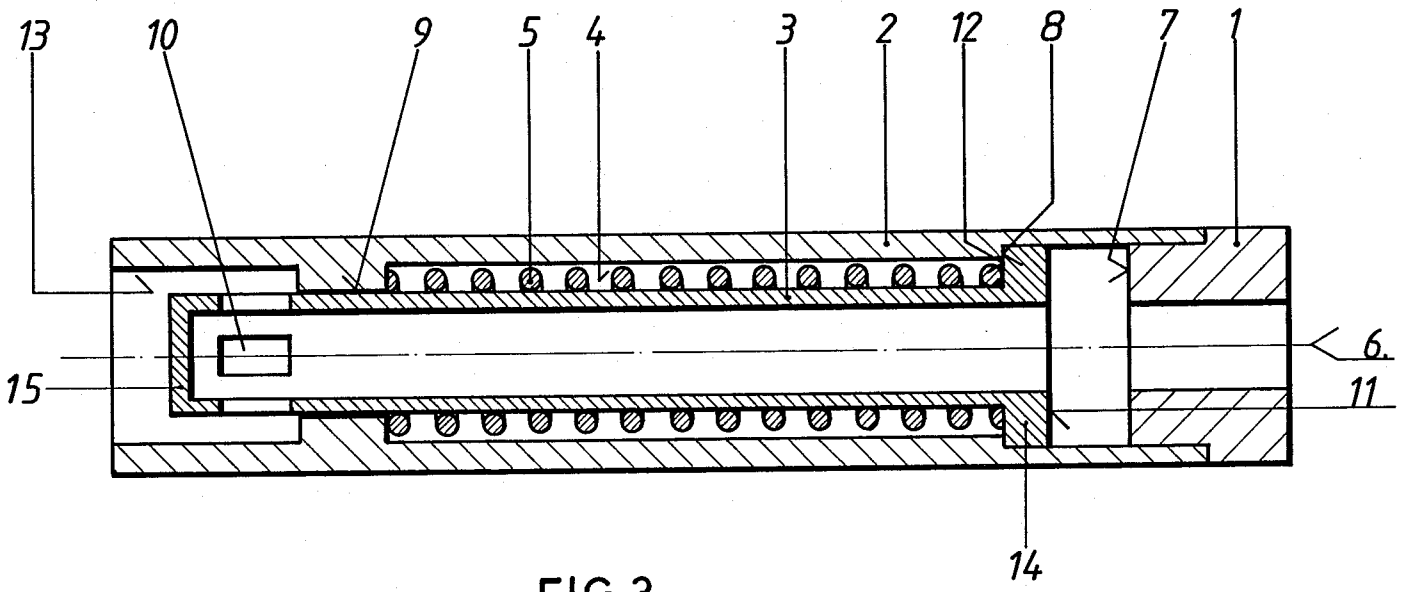
FIG. 3 is a section through the starting valve in the opened position.

At the other end of the tubular piston 3 there is a larger diameter section 14 of the piston, of which, in the position as shown in FIG. 2, one end face 11 fits closely against the abutment face 7 of the valve closure stopper 1. The opposite side 12 of the piston section 14 abuts against a stop 8 in the housing 2 when the piston is displaced as in FIG. 3 under the influence of the compressed air.

As long as the larger diameter section 14 of the tubular piston 3 is in the position shown in FIG. 2 the compressed air supplied via the hose connection 6 acts only on the inner surface of the tubular piston 3. If the air pressure increases so that the force acting on the tubular piston 3 exceeds the oppositely acting force of the compression spring 5, the tubular piston 3 is displaced so that the rear end face 11 of the larger diameter section 14 of the piston lifts from the abutment surface 7. At that moment the air pressure acts not only on the inner surface of the tubular piston 3 but also on the end face 11 of the piston section 14. Since the force acting on the tubular piston 3 and the piston section 14 is now considerably greater than the force of the pressure spring 5, the tubular piston 3 suddenly moves until the piston section 14 is in the position shown in FIG. 3. This brings the radial through openings 10 out of the region of the bore 9 into the region of the air passage 13, and the pressure wave that is thus generated strikes the striker piston of the ram boring machine 16 without appreciable damping and immediately sets it in motion without the risk of stopping in a dead centre position.

If the supply of compressed air is interrupted and the pressure in the ram boring machine 16, in the compressed air hose 1 and in the starting valve 1 falls so far that the force of the compression spring 5 suffices to move the tubular piston 3 back so that the piston part 14 is in the starting position, the starting valve 18 is ready for a new start.

What is claimed is:

1. A ram boring machine comprising a striker piston axially moveable in a tubular housing and acted on by compressed air on alternate sides, a hose connected to a source of compressed air, a valve upstream of the striker piston, the valve being a starting valve and including a control piston, the control piston having forward and rearward ends, the control piston being moveable in a housing, the control piston being sealingly guided in the housing at the forward and rearward ends thereof, first pressure means for exerting a permanent force on the control piston, second pressure means exerting a permanent force on the control piston in an opposite direction of the force exerted by the first pressure means, the control piston opening the valve independently and suddenly at a predetermined pressure when the striking piston is in a dead center position, whereby a pressure shock acts on the striker piston.

2. A ram boring machine according to claim 1, wherein the valve is arranged in the housing.

3. A ram boring machine according to claim 1, wherein the valve is arranged in the hose supplying said compressed air.

4. A ram boring machine according to claim 1, wherein the valve is controlled by compressed air.

5. A ram boring machine according to claim 4, to wherein the control piston has faces acted on hydraulically, by gas or by compressed air that are of different sizes in the closed and open states.

6. A ram boring machine according to claim 5, wherein the control piston is held in the direction of the closed position by means of a spring.

7. A ram boring machine according to claim 6, wherein the control piston is a tubular stepped piston.

8. A ram boring machine according to claim 7, wherein the tubular piston is closed at one end face and is sealed and guided in its housing in this region; has radial through openings; and has a larger diameter piston section at the other end face.

9. A ram boring machine according to claim 8, wherein in the closed position the end face of the larger diameter section of the piston abuts against and forms a seat with a corresponding abutment surface of the housing.

10. A ram boring machine according to claim 6, wherein there is an annular space between the control piston and its housing in which there is a compression spring.

* * * * *